US007171138B2

(12) United States Patent
Morimoto et al.

(10) Patent No.: US 7,171,138 B2
(45) Date of Patent: Jan. 30, 2007

(54) IMAGE FORMING APPARATUS

(75) Inventors: Shigenori Morimoto, Nara (JP); Yasuhiro Takai, Nara (JP); Atsushi Ueda, Nara (JP); Takahisa Narikiyo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 158 days.

(21) Appl. No.: 11/059,383

(22) Filed: Feb. 17, 2005

(65) Prior Publication Data

US 2005/0185976 A1 Aug. 25, 2005

(30) Foreign Application Priority Data

Feb. 23, 2004 (JP) ..... 2004-046550

(51) Int. Cl.
*G03G 21/00* (2006.01)

(52) U.S. Cl. ..... 399/98

(58) Field of Classification Search ..... 399/177, 399/98, 118, 51

See application file for complete search history.

(56) References Cited

U.S. PATENT DOCUMENTS 6,795,219 B2 * 9/2004 Fujita ..... 399/98

FOREIGN PATENT DOCUMENTS

| | | |
|---|---|---|
| JP | 04-323669 | 11/1992 |
| JP | 08-286472 | 11/1996 |
| JP | 2003-287938 | 10/2003 |

* cited by examiner

*Primary Examiner*—Susan Lee
(74) *Attorney, Agent, or Firm*—Nixon & Vanderhye, P.C.

(57) ABSTRACT

In an image forming apparatus in which positioned below a development unit for accommodating a toner is an exposure unit that writes to a photosensitive drum by exposing an electrostatic latent image, an aperture portion on an upper surface of an exposure unit case positioned in an optical path of light from the exposure unit is provided so as to not become an impediment to the optical path of the light and a glass plate is inclined and provided on the aperture portion. An inclination angle of the glass plate is set to an angle inclined 40° with respect to a horizontal line so as to be greater than a repose angle of the toner when the toner has poor fluidity under a condition of high temperature and high humidity.

10 Claims, 4 Drawing Sheets

IMAGE FORMING APPARATUS

CROSS REFERENCE TO RELATED APPLICATIONS

This application claims priority under 35 U.S.C. § 119(a) on Patent Application No. 2004-46550 filed in Japan on Feb. 23, 2004, the entire contents of which are hereby incorporated by reference.

BACKGROUND OF THE INVENTION

1. Field of the Invention

The present invention relates to electrophotographic image forming apparatuses such as printers that are devised so as to prevent smearing of the exposure unit due to natural dropping of the developer and spattering of the developer, and particularly relates to measures for preventing soiling on the optical path of light that is exposed from exposure units.

2. Description of the Related Art

Conventionally, the layout of the paper-supply unit, printing unit, paper-discharge unit, and optical units (there are two types, an optical unit for reading manuscripts for printing and an optical unit for exposure that writes the image information that has been read to an electrostatic latent image carrier) that constitute an image forming apparatus has been determined with consideration to such factors as compactness of the apparatus, ease of operation, and ease of designing the apparatus.

Normally, the development unit that accommodates developer is positioned on the side of the photosensitive body, and the optical unit for exposure (in recent years, reading heads such as LSU, EL, and LED reading heads are used) is positioned above or diagonally above the photosensitive body, with many forms of exposure being used.

On the other hand, with color image forming apparatuses that strive for device compactness, a photosensitive body and a development unit are required for each color, but since the fixing device and sheet carry path are not required for each color, development has advanced of color image forming apparatuses known as "tandem technique," in which a color image is obtained in one pass of the paper. There are two styles of tandem technique, one being a style in which image information that is made as a development on the photosensitive body for each color is transferred directly to paper, and the other being a style in which image information that is made as a development on the photosensitive body for each color is temporarily superimposed on an intermediate medium (an intermediate transfer body), then transferred in a single transfer step to a sheet of paper. In this case, photosensitive bodies and development units for yellow, magenta, and cyan colors are of course respectively positioned in the color image forming apparatus, and naturally a photosensitive body and development unit for black, which is a high proportion of a user's printing, are also provided.

Here, in the latter case of the style using an intermediate transfer medium (hereinafter, an "endless belt"), the layout position of the photosensitive bodies arranged at the periphery of the endless belt is one determinant of the printing speed (fast copy speed) of the apparatus. That is to say, it is a necessary condition in order to achieve improved printing speed to respectively arrange a photosensitive body and development unit for the colors yellow, magenta, and cyan in order from a position distant from the transfer unit that transfers these colors together onto a sheet of paper, and to arrange a photosensitive body and development unit for black, which is the most printed color, in the closet position.

In regard to this, many apparatuses of the built-up format, which is also referred to as front access style, have been developed in recent years to reduce the area occupied by image forming apparatuses. That is to say, many apparatuses have been released in which a storage/supply unit for printing paper is arranged at the lowermost area of the apparatus, with the printing unit arranged above this and a scanner unit that reads the image information of the manuscript arranged at the highest position of the apparatus, while discharge of the printing paper is carried out at a side of the apparatus or an upper area of the printing unit with the scanner unit in a lower area.

In such apparatuses, in cases in which a technique is applied using an endless belt with the tandem technique, the carry direction of the paper is from bottom to top and the transfer unit is basically conceived as rotating in the same direction as the paper carry direction and, moreover, in considering the optimal layout positions of the paper transfer unit and the photosensitive body and development unit for each color, as well as improvements in printing speed, the layout from the lowermost area of the apparatus goes from the paper storage/supply unit, the optical unit for exposing the photosensitive body, the photosensitive bodies and the development units, and then the endless belt.

In this way, when positioning the development range (normally called "development nip") formed by the photosensitive body and the development sleeve with the development unit positioned above the optical unit for exposure, residual developer at the development nip area is caused by such factors as the flow of air produced by the peripheral speed of the photosensitive body and the development sleeve, or the loss of an electric field effect due to an electric field of the development sleeve, to be subjected to natural dropping by gravity or spattering within the machine.

In this way, the optical unit for exposure positioned below the development unit may be soiled by developer, which tends to cause reduced printing quality by disturbing the written image or damaging the polygon mirrors that rotate at high speed, as well as smearing the fθ lens and the plurality of mirrors.

From this point, regarding the relationship in which the optical unit for exposure is positioned below the photosensitive body and the development unit, a structure is necessary that shields this area from the outside in order to always keep clean the optical unit for exposure.

However, since the optical path from the optical unit for exposure cannot be blocked in order to write image information to the photosensitive body, it is necessary to leave an aperture portion at the portion where the optical path is incident, and this results in ingression of developer from the aperture portion into the optical unit for exposure.

Accordingly, apparatuses have been proposed (see JP H04-323669A for example) in which an openable-closeable shutter is arranged at the portion (aperture portion) where the optical path crosses from the optical unit for exposure, and prevents soiling caused by the ingression of developer from the aperture portion, thus keeping the optical unit for exposure always clean.

Furthermore, there are apparatuses of other techniques in which glass is arranged at the portion where the optical path of the optical unit crosses such that soiling caused by the ingression of developer from the aperture portion is prevented, thus keeping the optical unit for exposure always clean.

However, with an apparatus such as that mentioned above, which is provided with an openable-closeable shutter at the portion (aperture portion) where the optical path crosses from the optical unit such as the optical unit for exposure, there is uncertainty as to whether or not the shutter mechanism can properly fulfill its function in regard to the operation of the apparatus. That is to say, a greater portion of the dropping and spattering of the developer is produced during the printing process and at that time the shutter is required to stay open during exposure so that the exposure unit can write image information to the image carrier such as the photosensitive body. For this reason, when the shutter is in an open state, it is unable to block the dropped/spattered developer and is unable to prevent soiling by developer inside the exposure unit such that the shutter function cannot be considered to be sufficiently effective. In short, the shutter is for preventing the dropping of the developer during movement of the apparatus or during replacement operations of the developer or the image carrier or the like, and is not able to prevent soiling caused by ingression of the developer into the exposure unit at the time of using exposure to write image information onto the image carrier.

In contrast to this, with an apparatus such as that described above in which glass is arranged at a portion (aperture portion) where the optical path crosses from the exposure unit, this is nothing more than simply the arrangement of transparent glass on the optical path of the exposed light, and even if the glass is cleaned periodically, the risk of dropped/spattered developer accumulating on the glass is posed during the cleaning interval from after cleaning until the next cleaning, and if the optical path is soiled by developer, image information cannot be accurately written to the image carrier using exposure.

The present invention has been devised in consideration of these issues, and it is an object thereof to provide an image forming apparatus that can reliably prevent ingression of developer to the exposure unit when writing onto an image carrier by exposing image information and is capable of accurately writing on the image carrier by exposing image information by preventing soiling on the optical path of the exposed light by developer.

SUMMARY OF THE INVENTION

In order to achieve the above-described object, the present invention presupposes an image forming apparatus wherein, positioned below a development unit for accommodating a developer that develops an electrostatic latent image formed on an image carrier into a visible image, is an exposure unit that writes the electrostatic latent image onto the image carrier by exposure. A transparent plate that prevents smearing of the exposure unit caused by dropping or spattering of the developer is arranged at an inclination in an optical path of light irradiated from the exposure unit toward the image carrier. Further still, an inclination angle of the transparent plate is set at an angle not less than a repose angle indicative of fluidity of the developer to be used.

Accordingly, with this aspect, the transparent plate provided on the optical path of the light exposed from the exposure unit toward the image carrier, that is, the portion where the optical path of the exposure unit crosses, is inclined at an angle not less than the repose angle indicative of the fluidity of the developer to be used, and therefore it is possible to use the transparent plate to block the developer that drops and spatters and to reliably prevent soiling caused by developer inside the exposure unit. Moreover, even if the dropped/spattered developer drops on the transparent plate, upon dropping, the developer flows down in the inclination direction of the plate, which has an inclination angle not less than the repose angle, and there is no accumulation of the dropped/spattered developer on the plate such that soiling on the optical path by the developer is eliminated and image information can be accurately written to the image carrier by exposure. Further still, the inclination angle of the plate is set according to the type of developer, which is very beneficial in executing the present embodiment.

In particular, the following configurations can be presented as specific settings of the inclination angle of the transparent plate.

In the above-described aspect of the present invention, the repose angle of the developer may be set based on when the developer to be used has poor fluidity under a condition of high temperature and high humidity.

With the above-described aspect of the present invention, even under conditions in which the developer has poor fluidity when in a state of high temperature and high humidity, and of course under conditions in which the developer has good fluidity when in a state of low temperature and low humidity and a state of normal temperature and normal humidity, each time dropped/spattered developer drops onto the transparent plate, it is possible to make the developer flow down the plate in the inclination direction without dropped/spattered developer accumulating on the plate, such that soiling on the optical path by the developer is reliably eliminated and image information can be very accurately written to the image carrier by exposure.

Furthermore, in the above-described aspect of the present invention, an inclination angle of the transparent plate may be set at such an angle that the transparent plate intersects at a substantially right angle the optical path of light irradiated from the exposure unit toward the image carrier. In this case, no difference is produced between the incident angle and the outgoing angle when the light of the optical path passes through the plate and is irradiated toward the center of the image carrier without receiving any effect due to the refractive index of the light of the optical path. In this way, there is no displacement of the irradiation position of the image to be written and no blurry image is produced and, in particular, occurrences such as positional displacement of images by color image forming apparatuses, misregistration, and color displacement are reliably suppressed such that it is possible to achieve improvement in printing quality.

And, in the above-described aspect of the present invention, an inclination angle of the transparent plate may be set at an angle greater than 20° and smaller than 90° with respect to a horizontal line. In this case, the range in which the inclination angle of the transparent plate can be set such that it becomes an angle that meets a substantial right angle with respect to the optical path of light exposed from the exposure unit becomes wider and in addition to being able to even improve the layout qualities of the exposure unit without any loss of fluidity of the developer on the transparent plate, it is possible to achieve compactness of the exposure unit and the image forming apparatus.

Further still, in the above-described aspect of the present invention, an inclination angle of the transparent plate may be set at an angle greater than 30° and smaller than 60° with respect to a horizontal line. In this case, the range in which the inclination angle of the transparent plate can be set such that it becomes an angle that meets a substantial right angle with respect to the optical path of light exposed from the exposure unit can be widely secured and in addition to being able to increase fluidity of the developer on the plate and improve the layout qualities of the exposure unit, there is a benefit in that it is possible to achieve compactness of the exposure unit and the image forming apparatus.

Furthermore, in particular, the following configurations can be presented as specific settings of a surface of the plate on the side of the image carrier.

In the above-described aspect of the present invention, a surface of the transparent image plate on the side of the image carrier may be provided with a surface coat layer applied by a coating process to increase slipperiness in an inclination direction of a developer that drops on that surface of the image carrier.

With the above-described aspect of the present invention, when dropped/spattered developer drops on the plate, it is possible to make the developer actively flow down the plate in the inclination direction due to the surface coat layer and effectively prevent accumulation of the dropped/spattered developer on the plate, and soiling on the optical path by the developer is very reliably eliminated such that image information can be further still accurately written to the image carrier by exposure.

In the above-described aspect of the present invention, the surface coat layer may be processed so that an indentation depth of a surface thereof becomes smaller than half the mean particle size of the developer. In this case, even when dropped/spattered developer drops onto the plate and enters indentations on the surface of the surface coat layer, since the depth of these indentations is smaller than half the mean particle size of the developer, the particles of the developer easily slip out of the indentations due to the inclination of the plate with no loss of fluidity, thus reliably preventing accumulation of the developer on the plate.

Further still, in the above-described aspect of the present invention, the surface coat layer may be processed so that an indentation depth of a surface therein becomes smaller than one third to one quarter of the mean particle size of developer. In this case, even when dropped/spattered developer drops onto the plate and enters indentations on the surface of the surface coat layer, since the depth of these indentations is smaller in the range of one third to one quarter of the mean particle size of the developer, the particles of the developer easily slip out of the indentations due to the inclination of the plate with almost no loss of fluidity, thus even more reliably preventing the accumulation of developer on the plate.

Furthermore, in particular, the following configurations can be presented as specific settings for actively increasing the fluidity of the developer.

That is, in the above-described aspect of the present invention, linked at one end of an inclination direction or one end of a direction perpendicular to the inclination direction of the transparent plate may be an oscillation member that subjects the plate to amplitude movement in at least the inclination direction or the direction perpendicular to the inclination direction, and linked at another end of the inclination direction or another end of the direction perpendicular to the inclination direction of the transparent plate may be an elastic member that allows amplitude movement of the plate in the inclination direction or the direction perpendicular to the inclination direction.

With the above-described aspect of the present invention, between the plate between the oscillation member and the elastic member is subjected to amplitude movement in the inclination direction or a direction perpendicular to the inclination direction, and developer that drops onto the plate is made to actively flow along the inclination such that it is possible to even more effectively prevent accumulation of developer on the plate.

Further still, in the above-described aspect of the present invention, below a lower end in inclination direction of the transparent plate, a receiving member is provided for collecting developer that drops on a surface of the transparent plate on the image carrier side and flows along an inclination. In this case, it is possible to quickly collect in the receiving member the developer that has dropped on the plate such that adherence of smearing by the developer inside the image forming apparatus is suppressed as much as possible, which enables improved printing quality and long life of the image forming apparatus to be achieved.

In sum, as described above, by inclining the transparent plate on the optical path of light exposed from the exposure unit toward the image carrier to an angle greater than the repose angle of the developer, it is possible to use the plate to block the developer that drops and spatters and to reliably prevent soiling caused by developer inside the exposure unit. Moreover, each time dropped/spattered developer drops on the plate, the developer is made to flow down in the inclination direction, thus preventing accumulation on the plate such that soiling on the optical path by the developer is eliminated and image information can be accurately written to the image carrier by exposure. Further still, the inclination angle of the plate can be set according to the type of developer, which is very beneficial in executing the present embodiment.

BRIEF DESCRIPTION OF THE DRAWINGS

FIG. 3(*a*) shows a condition in which a predetermined amount of toner has been put into a container prior to measuring the repose angle of the toner. FIG. 3(*b*) shows a condition in which the toner in the container starts to flow out from a funnel of a measuring device. FIG. 3(*c*) shows a condition in which the toner is subject to natural dropping from a bottom portion aperture of the funnel onto a flat plate and accumulates in a conical form. FIG. 3(*d*) shows how the repose angle of the toner that has accumulated in a conical form on the flat plate is obtained.

FIG. 4(*b*) shows a condition in which the glass plate is moved to an upper side in an inclination direction when power to the actuator is turned off. FIG. 4(*c*) shows a condition in which the glass plate is moved to a lower side in an inclination direction when power to the actuator is turned on.

DESCRIPTION OF THE PREFERRED EMBODIMENTS

Hereinafter, embodiments of the present invention will be described with reference to the accompanying drawings. The present embodiment is described regarding a case in which the present invention is applied to a color printer.

Description of the Overall Configuration of the Image Forming Apparatus

Figure 1:
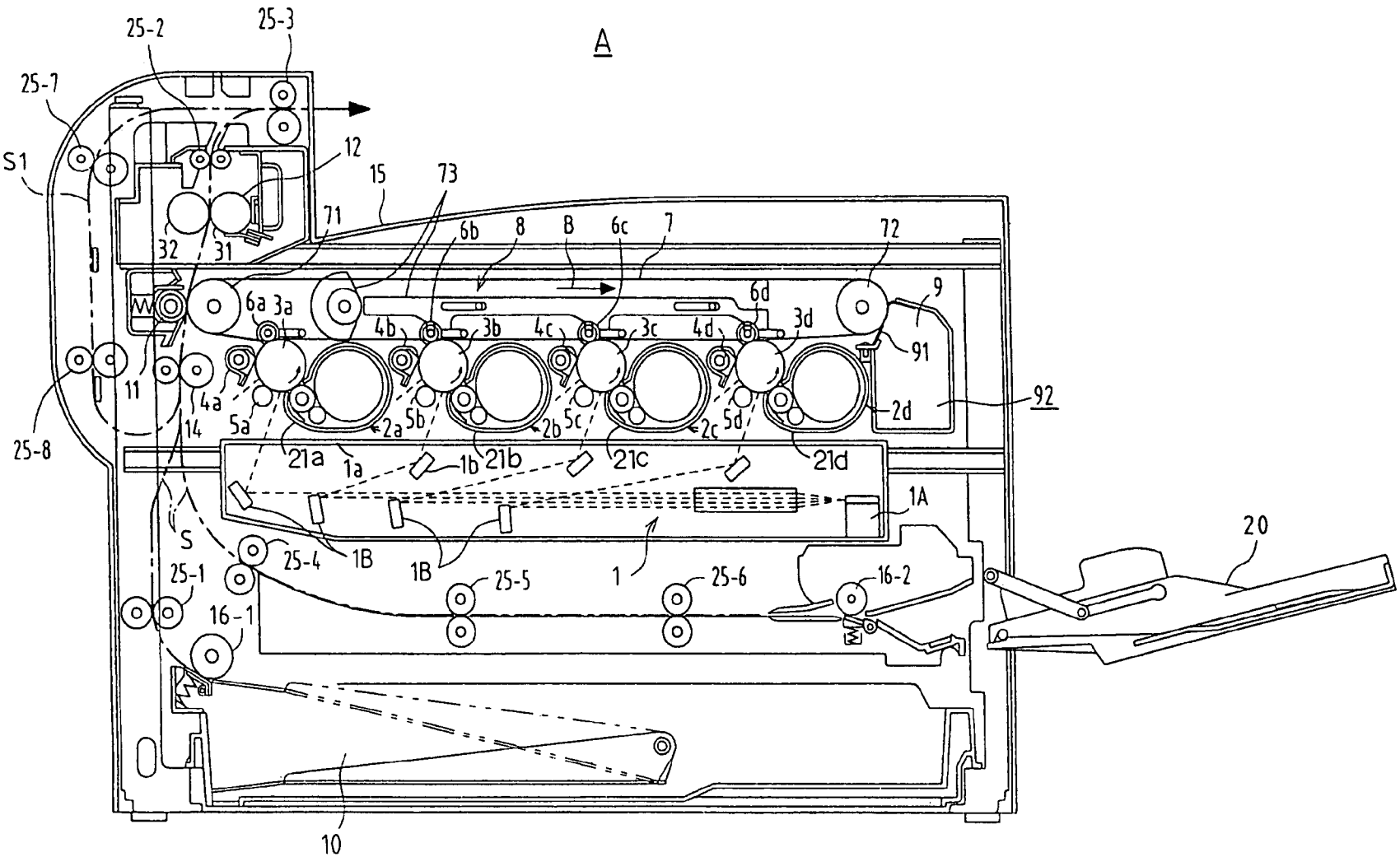
FIG. 1 shows an internal configuration of an image forming apparatus according to an embodiment of the present invention.

FIG. 1 shows an outline of the internal configuration of an image forming apparatus A according to the present embodiment. In response to image data transmitted from an external portion (a terminal device such as a personal computer for example), the image forming apparatus A forms a multicolor (full color) image or a single color (monochrome) image on a predetermined sheet (sheet of recording paper). As shown in FIG. 1, the image forming apparatus A is configured provided with an exposure unit 1, a development apparatus 2 (2*a* to 2*d*), a photosensitive drum 3 (3*a* to 3*d*) as an image carrier, a charger 5 (5*a* to 5*d*), a cleaner unit 4 (4*a* to 4*d*), an intermediate transfer belt unit 8, a fixing device 12, a sheet carry path S, a paper supply cassette 10, a paper discharge tray 15, and so on.

It should be noted that image data handled in the image forming apparatus A corresponds to color images using the colors black (K), cyan (C), magenta (M), and yellow (Y). Consequently, the development apparatuses 2 (2*a* to 2*d*), the photosensitive drums 3 (3*a* to 3*d*), the chargers 5 (5*a* to 5*d*), and the cleaner units 4 (4*a* to 4*d*) are configured in four stations (image forming portions) with these being arranged respectively in four groups to form four latent images according to the colors and, in FIG. 1, these are set such that "a" is black, "b" is cyan, "c" is magenta, and "d" is yellow.

The photosensitive drum 3 is positioned (mounted) in an upper portion of the image forming apparatus A and is configured so as to form an electrostatic latent image corresponding to image data by the irradiation of laser light from the exposure unit 1, which will be described below.

The charger 5 is a charging means for uniformly charging the surface (photosensitive layer) of the photosensitive drum 3 to a predetermined electric potential and in addition to contact types such as roller and brush chargers, charge-type chargers are also used.

The exposure unit 1 is constituted by a laser scanning unit (LSU) provided with a laser irradiation portion 1A and reflector mirrors 1B in an exposure unit case 1*a*. The laser irradiation portion 1A irradiates laser light for each color based on received image data. In addition to this, there are also techniques in which light-emitting elements are arranged in an array using for example an EL or LED writing head. The exposure unit 1 has the function of forming an electrostatic latent image on the photosensitive drum 3 according to input image data by exposing the charged photosensitive drum 3 according to the image data.

The development apparatus 2 uses toner (developer) of each color (K, C, M, Y) to turn the electrostatic latent images respectively formed on the photosensitive drums 3 into developments. The toners of these colors are respectively accommodated in development units 21*a* to 21*d* of the development apparatuses 2*a* to 2*d* of each image station. The exposure unit 1 is positioned below these development units 21 (21*a* to 21*d*).

The cleaner units 4 remove and collect toner that is residual on the surface of the photosensitive drums 3 after development and image transfer.

The intermediate transfer belt unit 8 positioned above the photosensitive drums 3 is provided with an intermediate transfer belt 7, an intermediate transfer belt drive roller 71, an intermediate transfer belt tension mechanism 73, an intermediate transfer belt following roller 72, intermediate transfer rollers 6 (6*a* to 6*d*) as primary transfer rollers, and an intermediate transfer belt cleaning unit 9.

The intermediate transfer belt 7 spans the intermediate transfer belt drive roller 71, the intermediate transfer belt tension mechanism 73, the intermediate transfer rollers 6, and the intermediate transfer belt following roller 72 and is made to travel in the direction of arrow B along with the rotational drive of the intermediate transfer belt drive roller 71.

The intermediate transfer rollers 6 are rotationally supported on roller mounting portions in the intermediate transfer belt tension mechanism 73. In this way, the intermediate transfer rollers 6*a* to 6*d* are in a state in which they are rotationally arranged on an inner surface side of the intermediate transfer belt 7 in opposition to the photosensitive drums 3, and apply a transfer bias for transfer the toner images on the photosensitive drums 3 onto the intermediate transfer belt 7.

The intermediate transfer belt 7 is contactably arranged at the respective photosensitive drums 3. And a color toner image (an image composed of multiple color toners) is formed on the intermediate transfer belt 7 by each color toner image formed on the photosensitive drums 3 being superimposed and transferred in order to the intermediate transfer belt 7. It should be noted that the intermediate transfer belt 7 is formed as an endless belt using a film of a thickness in the range of 100 μm to 150 μm.

Transfer of the toner images from the photosensitive drums to the intermediate transfer belt 7 is carried out by the intermediate transfer rollers 6 that are in contact with the rear side (inside surface side) of the intermediate transfer belt 7. That is, a high voltage transfer bias (a high voltage (+) that has inverse polarity to the charge polarity (−) of the toner) is applied to the intermediate transfer rollers 6 to achieve transfer of the toner image. The intermediate transfer rollers 6 are based on metal (for example stainless steel) axles with a diameter of 8 to 10 mm and the surfaces thereof are covered by a conductive elastic material (for example, EPDM and urethane foam or the like). With this conductive elastic material, it is possible to apply a uniform high voltage to the intermediate transfer belt 7. In the present embodiment, roller shaped objects are used as the transfer electrodes, but it is also possible to use other objects such as brushes.

As described above, the toner images that are made as developments according to each color on each of the photosensitive drums 3*a* to 3*d* are layered onto the intermediate transfer belt 7, in accordance with the image information that has been input to the apparatus. In this way, with the travel of the intermediate transfer belt 7, the layered image information (image composed of multiple color toners) is transferred to a sheet of paper by the transfer roller 11 that constitutes the transfer unit arranged at a contact position between a sheet of paper, which will be described later, and the intermediate transfer belt 7.

At this time, the intermediate transfer belt 7 and the transfer roller 11 are pressed against each other by a predetermined nip and a voltage (a high voltage (+) that has inverse polarity to the charge polarity (−) of the toner) is applied to the transfer roller 11 in order for the toner to be transferred to the sheet of paper. Moreover, in order to steadily obtain the above-mentioned nip, either the transfer roller 11 or the above-mentioned intermediate transfer belt drive roller 71 is made of a hard material (metal etc.) and the other of these is made of a soft material such as an elastic roller (elastic rubber roller or foam resin roller or the like).

Furthermore, as described above, the toner that adheres to the intermediate transfer belt 7 by contact with the photosensitive drums 3, or the residual toner on the intermediate transfer belt 7 not transferred to the sheet of paper by the transfer roller 11, is a cause of mixed color toner in the next process, and is therefore removed and recovered by the intermediate transfer belt cleaning unit 9. The intermediate transfer belt cleaning unit 9 is provided with a cleaning blade 91 for example as a cleaning member that contacts the intermediate transfer belt 7, and is supported from the rear side at the intermediate transfer belt following roller 72 with respect to the intermediate transfer belt 7 that the cleaning blade 91 contacts. The residual toner recovered by the cleaning blade 91 drops down to and accumulates in a storage portion 92 installed below the cleaning blade 91.

The paper supply cassette 10 is for storing the sheets (sheets of recording paper) that are to be used for image formation and is provided at the lowest area of the image forming apparatus A, that is, below the exposure unit 1. Furthermore, the paper discharge tray 15 arranged in an upper portion of the image forming apparatus A is for loading the printed sheets face down.

Furthermore, a sheet carry path S is provided in the image forming apparatus A for sending the sheets in the paper supply cassette 10 to the paper discharge tray 15 via the transfer roller 11 and the fixing device 12. The sheet carry path S extends from a paper discharge area of the paper supply cassette 10 toward the paper discharge tray 15 in a substantially vertical direction. Further still, arranged on the sheet carry path S from the paper supply cassette 10 to the paper discharge tray 15 are a pickup roller 16 (16-1), a register roller 14, the transfer roller 11, the fixing device 12, and carry rollers 25 (25-1, 25-2, 25-3) that carry the sheets.

The carry rollers 25 are small-size rollers for facilitating and assisting the carrying of the sheets and a plurality of these are provided along the sheet carry path S. The pickup roller 16 is provided at an end portion of the paper supply cassette 10 and is a pull-in roller that supplies sheets one by one from the paper supply cassette 10 to the sheet carry path S.

Furthermore, the register roller 14 temporarily holds the sheets that are carried in the sheet carry path S. The register roller has the function of carrying each sheet to the transfer portion (the nip area between the transfer roller 11 and the intermediate transfer belt drive roller 71) with a timing that aligns a leading edge of the toner image on the intermediate transfer belt 7 and a leading edge of the sheet.

The fixing device 12 is provided with a heat roller 31 and a pressure roller 32, and the heat roller 31 and the pressure roller 32 are configured so as to rotate and sandwich the sheet. Furthermore, the heat roller 31 is set by a control portion so as to attain a predetermined fixing temperature based on a signal from an unshown temperature detector, and has the function of melting, mixing, and pressing the multicolor toner image transferred to the sheet to thermally fix it to the sheet by applying thermo-compression to the sheet along with the pressure roller 32.

It should be noted that the sheet on which a multicolor toner image has been fixed is carried on the sheet carry path S by the carry rollers 25 and discharged to the paper discharge tray 15 with the multicolor toner image facing down.

The following is a detailed description of the path by which the sheets are carried. In the present image forming apparatus, along with the paper supply cassette 10 arranged to store sheets in advance, a manual loading tray 20 is arranged such that opening and closing of the paper supply cassette 10 is not required when the user is to print a small number of sheets.

In both paper supply methods, pickup rollers 16 (16-1 and 16-2) are arranged such that sheets are guided one by one to the carry path.

A sheet carried from the paper supply cassette 10 is carried to the register roller by the carry roller 25-1 on the carry path, then carried to the transfer roller 11 with a timing in which the leading edge of the sheet and the leading edge of the image information on the intermediate transfer belt 7 are matching such that the image information is written onto the sheet. After this, unfixed toner on the sheet is melted and fixed with heat by the passing of the sheet through the fixing device 12, and the sheet is discharged (when single-side printing is requested) to the paper discharge tray 15 from a paper discharge roller 25-3 via a the carry roller 25-2.

On the other hand, a sheet loaded in the manual loading tray 20 is supplied by the pickup roller 16-2 and reaches the register roller 14 via a plurality of carry rollers (25-6, 25-5, 25-4), after which it is discharged (when single-side printing is requested) to the paper discharge tray 15 via the same process as the sheet supplied from the paper supply cassette 10.

At this time, when the requested printing is double sided printing, single sided printing is completed as described above and then the trailing edge of the sheet that has passed through the fixing device 12 is chucked by the above-mentioned discharge roller 25-3, and after being guided to a switch back carry path S1 provided with carry rollers (25-7, 25-8) by the reverse rotation of the paper discharge roller 5-3, reverse side printing is carried out via the register roller 14 after which the sheet is discharged to the paper discharge tray 15.

Then, at the time of an actual image forming operation, in order to reduce deterioration of the photosensitive drums 3 due to contact between the intermediate transfer belt 7 and the photosensitive drums 3, the intermediate transfer rollers 6 are moved in a direction to disconnect from the intermediate transfer belt 7 in response to a print request, and disconnection of the intermediate transfer belt 7 from the photosensitive drums 3 becomes possible as a consequence of this movement.

That is, there are color mode and monochrome print requests and for color mode, the intermediate transfer rollers 6 (6*a* to 6*d*) move so as to contact the rear surface of the intermediate transfer belt 7 and in this way the front surface of the intermediate transfer belt 7 and the photosensitive drums 3 (3*a* to 3*d*) are brought in contact and the toner image of each color can undergo a primary transfer to the intermediate transfer belt 7. On the other hand, for monochrome mode, only the intermediate transfer roller 6*a*, which is for forming black images, is moved so as to contact the rear surface of the intermediate transfer belt 7 and in this way the front surface of the intermediate transfer belt 7 and the photosensitive drum 3*a*, which is for forming black images, are brought in contact and a black toner image can undergo a primary transfer to the intermediate transfer belt 7.

Figure 2:
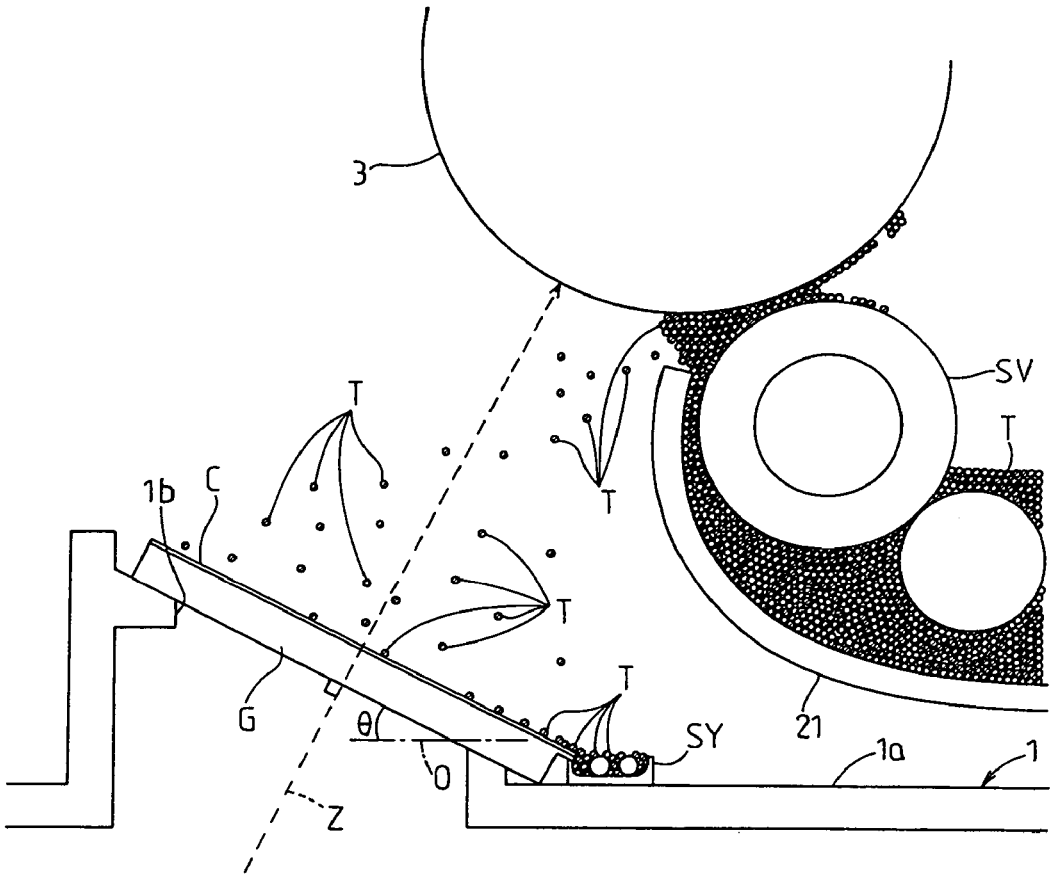
FIG. 2 is an explanatory diagram for describing the layout conditions of a glass plate in the vicinity of an aperture portion on an upper surface of an exposure unit positioned in an optical path of light exposed from an exposure unit towards a photosensitive drum.

As shown in FIG. 2, a characteristic aspect of the present invention is an aperture portion 1*b* that is provided on an upper surface of the exposure unit case 1*a* and positioned in an optical path Z (the dashed line in FIG. 2) of the light exposed from the exposure unit 1 toward the photosensitive drum 3 so as to not become an impediment to the optical path Z of the light. A glass plate G is inclined and provided as a transparent plate on the aperture portion 1*b* in order to prevent smearing of the exposure unit 1 caused by the ingression of toner T that has dropped or spattered in via the aperture portion 1*b*. In this case, dropped or spattered toner is caused by such factors as the flow of air produced by the peripheral speed of the photosensitive drum 3 and a development sleeve SV, or the loss of an electric field effect due to an electric field of the development sleeve SV, and the toner T accumulated at the development nip area is subjected to natural dropping by gravity or spattering within the machine.

Figure 3:
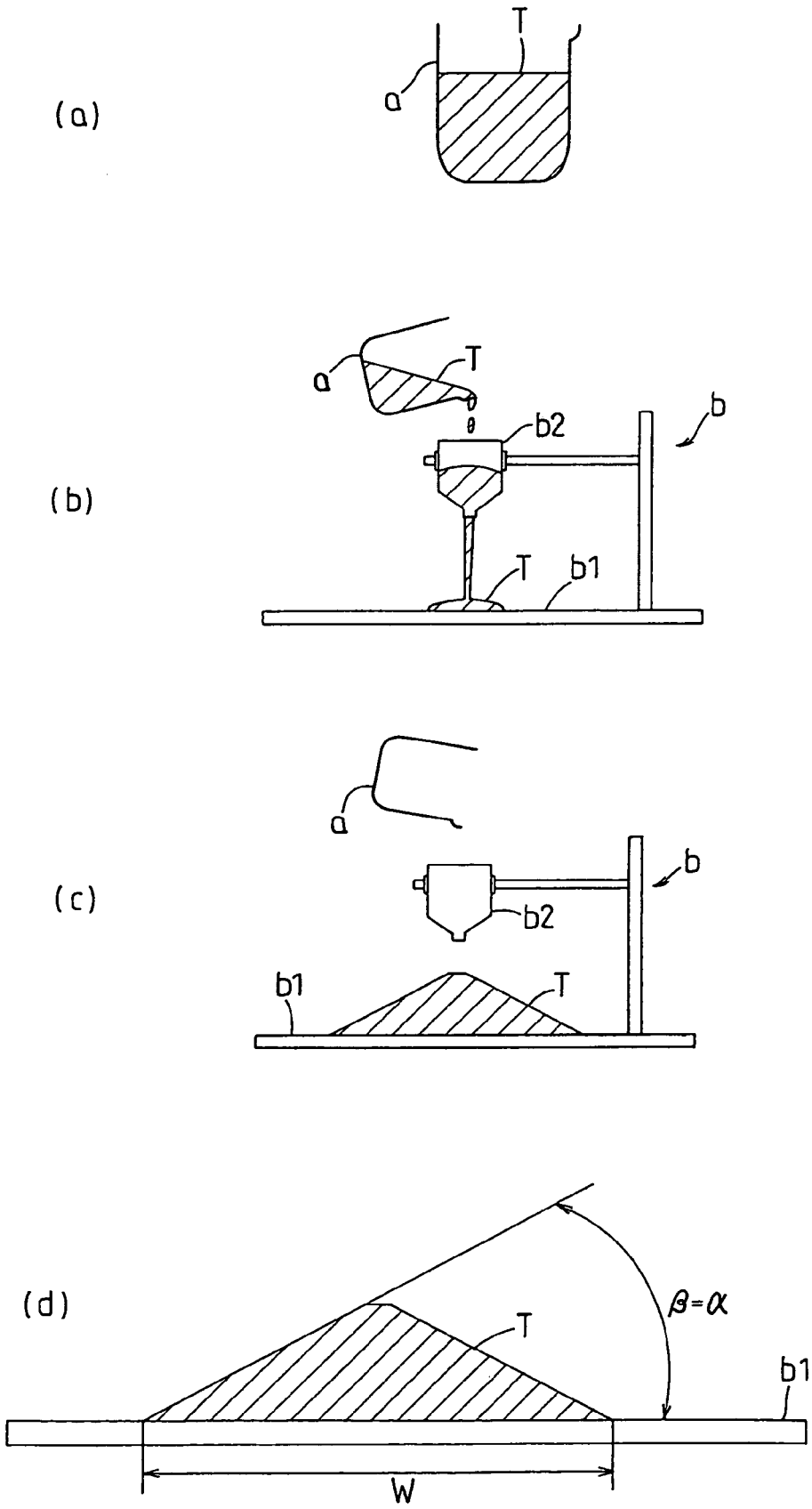
FIG. 3 shows a procedure of measuring a repose angle of toner.

Furthermore, the repose angle of the toner T was measured by putting a predetermined amount of toner into a container "a" as shown in FIG. 3(*a*) and using a measuring device "b" in which, as shown in FIG. 3(*b*), a funnel b2 is installed that has a bottom aperture above a flat plate b1. Specifically, toner T in the container "a" was poured into the funnel b2 of the measuring device "b" from above, then caused to accumulate in a substantially conical form by the natural dropping of the toner T onto the flat plate b1 from the bottom aperture of the funnel b2 as shown in FIG. 3(*c*), and a maximum diameter W and an inclination angle β of the toner T that had accumulated in a substantially conical form on the flat plate b1 as shown in FIG. 3(*d*) were measured to obtain the repose angle α(=β) as an indicator of the fluidity of the toner T.

At this time, as shown in Table 1 below, under conditions of low temperature (10° C.) and low humidity (20%), the repose angle of the toner T is in the range of 5° to 8°, and under conditions of normal temperature (25° C.) and normal humidity (60%), the repose angle of the toner T is in the range of 7° to 10°, while under conditions of high temperature (35° C.) and high humidity (85%), the repose angle of the toner T is in the range of 20° to 25°, thus making it evident that a causal relationship exists between the repose angle α and environment conditions.

TABLE 1

| Environment conditions | Repose angle (degrees) |
|---|---|
| Low temp./low humidity (10° C., 20%) | 5 to 8 |
| Norm. temp./norm. humidity (25° C., 60%) | 7 to 10 |
| High temp./high humidity (35° C., 85%) | 20 to 25 |

For this reason, in the present embodiment, based on the conditions under which the toner T has poor fluidity when in a state of high temperature and high humidity, an inclination angle θ of the glass plate G is set at an angle not less than the repose angle α indicative of the fluidity of the toner T that is used, specifically, greater than 30° and less than 60° (for example 40°) with respect to a horizontal line "o".

As shown in FIG. 2, the inclination angle θ of the glass plate G is set at an angle that meets a substantial right angle with respect to the optical path Z of light exposed from the exposure unit 1 toward the photosensitive drum 3. Furthermore, the surface of the glass plate G on the side of the photosensitive drum 3 (the upper side surface) is provided with a surface coat layer C applied by a coating process to increase its slipperiness in an inclination direction of the toner T that drops onto the surface on the side of the photosensitive drum 3. As for the surface coat layer C, a coating material is applied such as a fluorine by which rain that falls on an automobile's windshield is made to quickly wipe off, and it is processed so that the depth of indentations on the surface of the surface coat layer C are smaller than a half value (2 to 4 μm) of the mean particle size (4 to 8 μm) of the toner T. In this case, the slipperiness of the glass plate G is expressed by a water wetting angle, which is an indicator of general repellency to water or the like, and is increased by increasing the water wetting angle.

Figure 4:
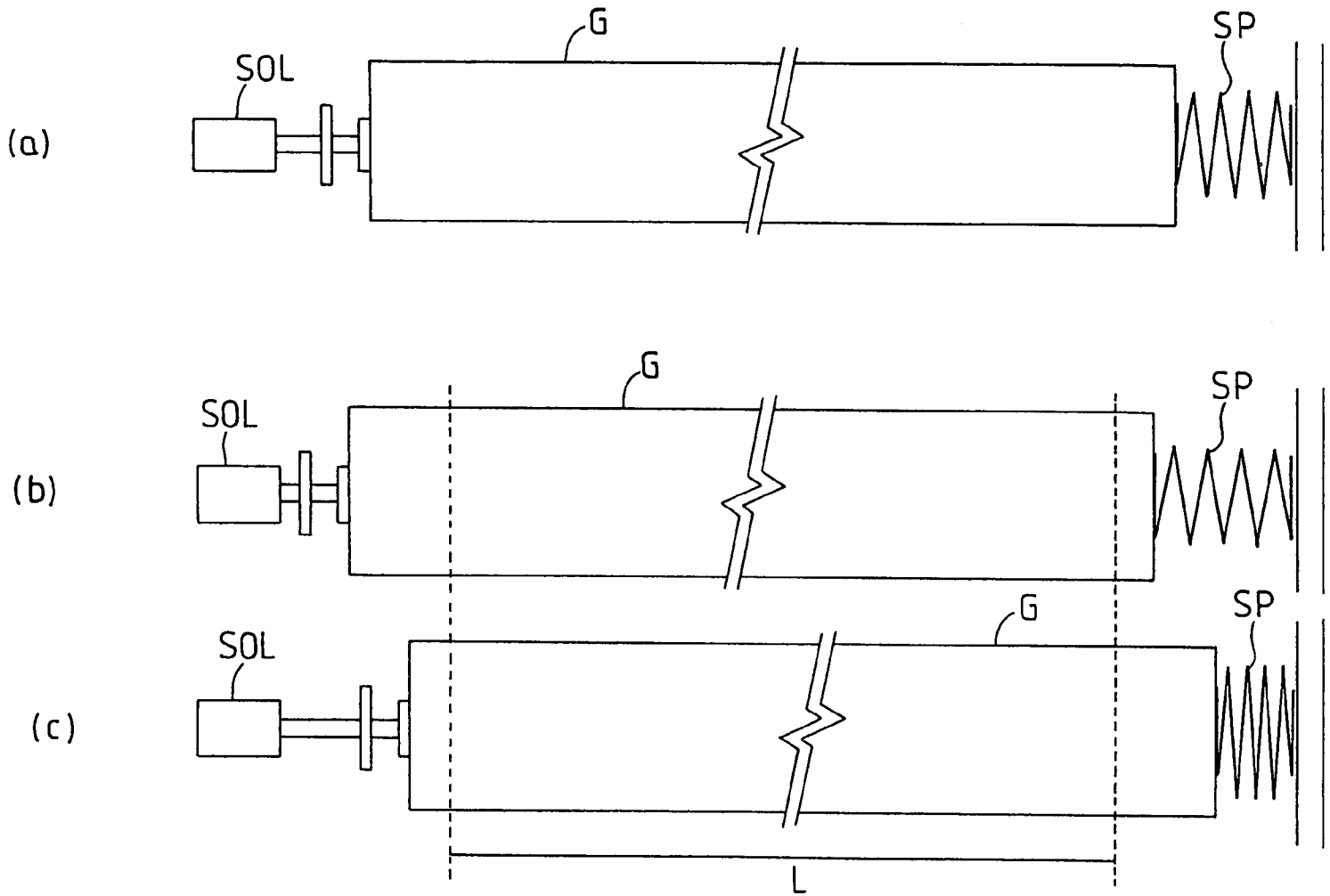
FIG. 4(*a*) shows a condition of the glass plate when an actuator is in a neutral state.

As shown in FIGS. 4(*a*) to 4(*c*), linked at one end (the left end in FIG. 4) in a primary scanning direction (the left-to-right direction in FIG. 4) perpendicular to an inclination angle of the glass plate G is a solenoid SOL that acts as an oscillation member causing amplitude movement of the glass plate G in the primary scanning direction, and linked at the other end (the right end in FIG. 4) in the primary scanning direction is a spring SP that acts as an elastic member allowing amplitude movement in the primary scanning direction of the glass plate G. As shown in FIG. 4(*b*), while the spring SP is lengthened and the glass plate G is moved to one end in the primary scanning direction by a contraction operation when power to the solenoid SOL is turned off, as shown in FIG. 4(*c*), the spring SP is contracted and the glass plate G is moved to the other end in the primary scanning direction by a lengthening operation when power to the solenoid SOL is turned on, and thus an amplitude movement can be carried out in the primary scanning direction of the glass plate G. It should be noted that, in FIG. 4, an exposure range L in the primary scanning direction of the glass plate G through which the optical path Z of the light passes is indicated by dashed lines.

Further still, as shown in FIG. 2, provided at a lower side in the inclination direction of the lower side end of the glass plate G is a carry screw member SY for carrying the toner T, which drops on the photosensitive drum 3 side thereof and flows downward along the inclination, until an end on one side that is perpendicular to the inclination direction of the glass plate G. And a receiving member (not shown in drawings) that collects the toner T carried by the carry screw member SY is provided at the end on one side that is perpendicular to the inclination direction of the glass plate G. In this case, the receiving member is positioned at a lower side of the end on one side that is perpendicular to the inclination direction of the lower side end in the inclination direction of the glass plate G.

Accordingly, in the present embodiment, the glass plate G provided on the optical path Z of the light exposed from the exposure unit 1 toward the photosensitive drum 3, that is, the portion where the optical path Z of the exposure unit 1 crosses, is inclined at an angle not less than the repose angle α that indicates the fluidity of the toner T to be used, for example, an inclination angle of 40° with respect to the horizontal line "o", and therefore it is possible to use the glass plate G to block the toner T that drops and spatters and to reliably prevent smearing caused by the toner T inside the exposure unit 1. Moreover, even if the dropped/spattered toner T drops on the glass plate G, the toner T flows down in the inclination direction of the glass plate G, which has an inclination angle (40°) not less than the repose angle α, and there is no accumulation of the dropped/spattered toner T on the glass plate G such that soiling on the optical path Z by the toner T is eliminated and image information can be accurately written to the photosensitive drum 3 by exposure. Further still, the inclination angle θ of the glass plate G is set according to the type of the toner T, which is very beneficial in executing the present embodiment.

Furthermore, since in addition to the repose angle α of the toner T being set based on conditions under which the toner T to be used has poor fluidity when in a state of high temperature and high humidity, the surface coat layer C applied by a coating process to increase the slipperiness of the toner T in the inclination direction is provided on the surface on the side of the photosensitive drum 3, and therefore, along with increased slipperiness with the surface coat layer C when dropped/spattered toner T drops on the glass plate G even under conditions in which the toner T has poor fluidity when in a state of high temperature and high humidity, and of course also under conditions in which the toner T has good fluidity when in a state of low temperature and low humidity and a state of normal temperature and normal humidity, it is possible to make the toner T actively flow down the plate member in the inclination direction and effectively prevent accumulation of the dropped/spattered toner T on the glass plate G, and soiling on the optical path Z by the toner T is very reliably eliminated such that image information can be further still accurately written to the image carrier by exposure. Moreover, by processing the surface of the surface coat layer C so that the depth of indentations thereon are smaller than half the mean particle size of the toner T, even when dropped/spattered toner T drops onto the glass plate G and enters indentations on the surface of the surface coat layer C, since the depth of these indentations is smaller than half the mean particle size of the toner T, the particles of the toner T slip out of the indentations due to the inclination of the glass plate G without loss of fluidity, thus reliably preventing the accumulation of the toner T on the glass plate G.

Additionally, since respectively linked at one end in the primary scanning direction perpendicular to the inclination angle of the glass plate G is a solenoid SOL that causes amplitude movement and a spring SP at the other end in the primary scanning direction allowing amplitude movement in the primary scanning direction of the glass plate G, the glass plate G is subjected to amplitude movement in the primary scanning direction between the solenoid SOL and the spring SP, and it is possible to let the toner T that has dropped on the glass plate G actively flow along the inclination and very effectively prevent accumulation of the toner T on the glass plate G. Furthermore, since the toner T that drops onto the surface of the glass plate G on the side of the photosensitive drum 3 and flows along the inclination is carried by the carry screw member SY until the end on one side that is perpendicular to the inclination direction of the glass plate G and collected by the receiving member thereunder, it is possible to quickly collect in the receiving member the toner T that has dropped on the glass plate G such that adherence of smearing by the toner T inside the image forming apparatus A is suppressed as much as possible, which enables improved printing quality and long life of the image forming apparatus A to be achieved.

Further still, since the inclination angle θ of the glass plate G is set at an angle that meets a substantial right angle with respect to the optical path Z of light exposed from the exposure unit 1 toward the photosensitive drum 3, no difference is produced between the incident angle and the outgoing angle when the light of the optical path Z passes through the glass plate G and is irradiated toward the center of the photosensitive drum 3 without receiving any effect due to the refractive index of the light of the optical path Z at the glass plate G. In this way, there is no displacement of the irradiation position of the image to be written and no blurry image is produced and, in particular, occurrences such as positional displacement of images by color image forming apparatuses, misregistration, and color displacement are reliably suppressed such that it is possible to achieve even greater improvement in printing quality.

It should be noted that the present invention is not limited to the above-described embodiment, but includes various other modified examples. For example, in the above-described embodiment, the inclination angle θ of the glass plate G is inclined to 40° with respect to the horizontal line "o", but as long as it is set not less than the repose angle of the toner, it may be set greater than 30° and less than 60° with respect to the horizontal line "o", in which case it is possible to maintain a wide range in which to set the inclination angle θ of the glass plate G such that it becomes an angle that meets a substantial right angle with respect to the optical path Z of light exposed from the exposure unit, and to improve the layout possibilities of the exposure unit 1 while greatly increasing the fluidity of the toner on the glass plate. Moreover, the inclination angle of the glass plate may be set greater than 20° and less than 90° with respect to the horizontal line as long as it is greater than the repose angle of the toner, in which case the range in which the inclination angle θ of the glass plate G can be set such that it becomes an angle that meets a substantial right angle with respect to the optical path Z of light exposed from the exposure unit becomes even wider and in addition to being able to even further improve the layout qualities of the exposure unit without any loss of fluidity of the toner on the glass plate, it is possible to achieve greater compactness of the exposure unit and the image forming apparatus.

Furthermore, in the above-described embodiment, processing was carried out so that the depth of indentations on the surface of the surface coat layer C became smaller than half the mean particle size of the toner T, but it is also possible to carry out processing such that the depth of indentations on the surface of the surface coat layer are smaller in the range of one third to one quarter (1 to 3 μm) of the mean particle size of the toner. In this case, even when dropped/spattered toner drops onto the glass plate and enters indentations on the surface of the surface coat layer, since the depth of these indentations is smaller in the range of one third to one quarter (1 to 3 μm) of the mean particle size of the toner, the particles of the toner easily slip out of the indentations due to the inclination of the glass plate with almost no loss of fluidity, thus reliably preventing the accumulation of the toner on the glass plate.

In the above-described embodiment, the glass plate G was provided at the aperture portion 1*b* on the upper surface of the exposure unit case 1*a* positioned on the optical path Z of the light exposed from the exposure unit 1 toward the photosensitive drum 3, but there is no limitation to this and plates such as an acrylic plate may be used as long as it is a transparent plate through which the exposure light can pass.

Furthermore, in the above-described embodiment, respectively linked at one end in the primary scanning direction perpendicular to the inclination angle of the glass plate G was a solenoid SOL that causes amplitude movement in the primary scanning direction and a spring SP at the other end in the primary scanning direction allowing amplitude movement in the primary scanning direction of the glass plate G, but it is also possible to respectively link at one end in the inclination direction of the glass plate a solenoid that causes amplitude movement of the glass plate in the inclination direction and a spring at the other end in the inclination direction allowing amplitude movement of the glass plate in the inclination direction. In this case, the glass plate can be subjected to amplitude movement in the inclination direction by causing the spring to lengthen and contract by switching to the power to the solenoid on and off.

Further still, in the above-described embodiment, a case was described in which the present invention was applied to the image forming apparatus 1 formed as a color printer, but the present invention is not limited to this and may be applied to apparatuses such as an image forming apparatus configured as a color copying machine or an image forming apparatus configured as a multifunctional machine provided with a plurality of functions.

The present invention can be embodied and practiced in other different forms without departing from the spirit and essential characteristics thereof Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus wherein, positioned below a development unit for accommodating a developer that develops an electrostatic latent image formed on an image carrier into a visible image, is an exposure unit that writes the electrostatic latent image onto the image carrier by exposure;

wherein a transparent plate that prevents smearing of the exposure unit caused by dropping or spattering of the developer is arranged at an inclination in an optical path of light irradiated from the exposure unit toward the image carrier, and wherein an inclination angle of the transparent plate is set at an angle not less than a repose angle indicative of fluidity of the developer to be used.

2. The image forming apparatus according to claim 1, wherein the repose angle of the developer is set based on when the developer to be used has poor fluidity under a condition of high temperature and high humidity.

3. The image forming apparatus according to claim 1, wherein an inclination angle of the transparent plate is set at such an angle that the transparent plate intersects at a substantially right angle the optical path of light irradiated from the exposure unit toward the image carrier.

4. The image forming apparatus according to claim 3, wherein the inclination angle of the transparent plate is set at an angle greater than 20° and smaller than 90° with respect to a horizontal line.

5. The image forming apparatus according to claim 3, wherein the inclination angle of the transparent plate is set at an angle greater than 30° and smaller than 60° with respect to a horizontal line.

6. The image forming apparatus according to any of the claims 1 to 5, wherein a surface of the transparent plate on the image carrier side comprises a surface coat layer applied by a coating process to increase slipperiness in an inclination direction of a developer that drops on that surface of the image carrier.

7. The image forming apparatus according to claim 6, wherein the surface coat layer is processed so that an indentation depth of surface thereof becomes smaller than half the mean particle size of a developer.

8. The image forming apparatus according to claim 6, wherein the surface coat layer is processed so that an indentation depth of a surface thereof becomes smaller than one third to one quarter value of the mean particle size of the developer.

9. The image forming apparatus according to any of the claims 1 to 5, wherein linked at one end of an inclination direction or one end of a direction perpendicular to the inclination direction of the transparent plate is an oscillation member that subjects the plate to amplitude movement in at least the inclination direction or the direction perpendicular to the inclination direction, and linked at another end of the inclination direction or another end of the direction perpendicular to the inclination direction of the transparent plate is an elastic member that allows amplitude movement of the plate in the inclination direction or the direction perpendicular to the inclination direction.

10. The image forming apparatus according to any of the claims 1 to 5, wherein, below a lower end in inclination direction of the transparent plate, a receiving member is provided for collecting developer that drops on a surface of the transparent plate on the image carrier side and flows along an inclination.

* * * * *